US005789133A

United States Patent [19]

Yabuuchi et al.

[11] Patent Number: 5,789,133

[45] Date of Patent: Aug. 4, 1998

[54] LIQUID DEVELOPER

[75] Inventors: Naoya Yabuuchi, Toyonaka; Yashuhiro Shibai, Osaka; Tsuyoshi Imamura, Katano, all of Japan

[73] Assignee: Nippon Paint Co., Ltd., Osaka, Japan

[21] Appl. No.: 796,736

[22] Filed: Feb. 6, 1997

[30] Foreign Application Priority Data

Feb. 9, 1996 [JP] Japan ..... 8-023754

[51] Int. Cl.[6] ..... G03G 9/135

[52] U.S. Cl. ..... 430/115; 430/112

[58] Field of Search ..... 430/112, 115

[56] References Cited

U.S. PATENT DOCUMENTS 4,966,824 10/1990 Niv et al. ..... 430/115

FOREIGN PATENT DOCUMENTS 0176630 4/1986 European Pat. Off. ..... 430/115

1518494 2/1968 France ..... 430/115

1-285955 11/1989 Japan ..... 430/115

*Primary Examiner*—Roland Martin

*Attorney, Agent, or Firm*—Townsend&Banta

[57] ABSTRACT

Toner particles having a polar group of either an acid group or a basic group at least on surface layers thereof are employed, and a polymer, which contains a polar group of reverse polarity to the polar group of the surface layers of the toner particles and is soluble in a medium, is added to the medium.

8 Claims, 2 Drawing Sheets

LIQUID DEVELOPER

BACKGROUND OF THE INVENTION

1. Field of the Invention

The present invention relates to a liquid developer for developing an electrostatic latent image in an electrophotographic process or the like.

2. Description of the Background Art

In an electrophotographic process, an electrostatic latent image is generally developed by dry development or wet development. The dry development is adapted to spray powder of a colorant onto an electrostatic latent image for sticking the former to the latter, and is advantageously excellent in handleability and toner preservability. In recent years, however, a high definition image having high resolution is demanded in application to a video printer or the like, and the grain size of the developer must be further refined in order to attain such high resolution. In the dry development, however, such refinement of the grain size disadvantageously results in aggregation of toner particles, expansion of charge quantity distribution, defective cleanability and the like.

In the wet development employing a liquid developer which is prepared by dispersing a dye or a pigment for serving as a colorant in an insulating medium, on the other hand, a toner having a smaller grain size than that in the dry development can be employed. Thus, high resolution and high gradation can be attained.

Such a liquid developer generally consists of a medium such as petroleum hydrocarbon having a high insulation property with volume resistivity of at least $10^9$ Ωcm and a dielectric constant of not more than 3.5, which contains a colorant such as carbon black, phthalocyanine or the like, toner particles for fixing a developed image integrated with or independent of the colorant, and a dispersion stabilizer for dispersing/stabilizing these particles.

In such a liquid developer, sufficient charge must be caused in the toner particles by application of an electric field. A method of preparing toner particles with a polymer such as an ethylene/methacrylic acid copolymer having a polar group is known as a method of supplying such charge.

However, toner particles obtained from such an ethylene/methacrylic acid copolymer insufficiently dissociate in the medium to have a low charge quantity as a result, and hence high image density cannot be obtained.

A method of adding a charge director which is dissolved in the medium is known as a method of increasing the charge quantity of toner particles. Various compounds such as anionic glyceride, lecithin, metallic soap, Basic Barium Petronate (trade name) and the like are known in relation to such a charge director. Further known is a liquid developer containing metal salt of hydroxycarboxylic acid such as aluminum hydroxycarboxylate as a charge adjuvant (refer to Japanese Patent Laying-Open No. 6-236074 (1994)). However, the charge director is soluble in the medium, and hence the volume resistance of the liquid developer is reduced to cause a problem in repeatability for halftone dots or thin lines. Thus, demanded is a liquid developer which can supply a sufficient charge quantity to toner particles without reducing the volume resistance as compared with the prior art.

SUMMARY OF THE INVENTION

An object of the present invention is to provide a liquid developer which can increase the charge quantity of toner particles without remarkably reducing the volume resistance thereby attaining high image density and excellent resolution.

The inventive liquid developer is prepared by dispersing toner particles in a medium, and is characterized in that the toner particles have a polar group of either an acid group or a basic group on surface layers thereof, and a polymer, which contains a polar group of reverse polarity to those on the surface layers of the toner particles and is soluble in the medium, is added into the medium.

According to the present invention, the polar group contained in the polymer is of reverse polarity to the polar group of the surface layers of the toner particles. Therefore, when the surface layers of the toner particles contain a relatively large quantity of acid group, a polymer containing a relatively large quantity of basic group is employed. When the surface layers of the toner particles have a relatively large quantity of basic group, on the other hand, a polymer having a relatively large quantity of acid group is employed.

The acid group may be prepared from those generating an anionic group by application of an electric field. Specifically, the acid group may be prepared from —COOH, $—SO_3Na$, $—SO_3NH_4$, $—OPO(OH)_2$ or the like. On the other hand, the basic group may be prepared from those generating cationic group by application of an electric field. Specifically, the basic group may be prepared from $—N(CH_3)_2$, $—N(C_2H_5)_2$, $—N(CH_3)_3Cl$ or the like.

The quantity of the polar group contained in the toner particles is preferably 0.005 to 5 mM (milli Mole), more preferably 0.01 to 0.5 mM, per gram of solid parts of the toner particles. The quantity of charge supplied to the toner particles tends to be insufficient if the quantity of the polar group is too small, while the volume resistance of the liquid developer tends to be reduced if the quantity of the polar group is too large.

The quantity of the polar group contained in the polymer is preferably 0.005 to 5 mM, more preferably 0.01 to 2 mM, per gram of the polymer. The quantity of charge induced to the toner particles tends to be reduced if the quantity of the polar group contained in the polymer is too small, while the volume resistance of the liquid developer tends to be reduced if the quantity of the polar group is too large.

According to the present invention, the polymer is preferably added into the medium so that the mole ratio of the polar group in the toner particles to those in the polymer (polar group in toner particles/polar group in polymer) is 100/90 to 100/1, more preferably 100/80 to 100/10. If the content of the polymer is too large, the toner particles are so readily bridged that desired resolution may not be attained. If the content of the polymer is too small, on the other hand, induction of the charge to the toner particles, which is the effect of the present invention, may be so insufficient that the toner particles cannot be sufficiently charged.

The grain sizes of the toner particles employed in the present invention are preferably in the range of 0.05 to 5 μm, more preferably in the range of 0.2 to 2 μm. Fogging is readily caused if the grain sizes are too small, while resolution is reduced if the grain sizes are too large.

In the liquid developer according to the present invention, the content of the toner particles is not particularly restricted but a general content for a liquid developer can be employed. For example, the inventive liquid developer can contain 1 to 50 percent by weight of toner particles. It may be impossible to obtain a sharp image if the content of the toner particles is too small, while aggregation of the toner particles may be caused if the content is too large.

Method of Preparing Toner Particles

The toner particles employed in the present invention are not particularly restricted but may be prepared from resin particles which can be employed as toner particles for a liquid developer. Such toner particles may be prepared to contain a colorant, or may be mixed into the liquid developer independently of the colorant.

The toner particles prepared to contain a colorant can be prepared by wet grinding, latex mixing, or interfacial polymerization, for example. These methods of preparing toner particles are now described.

Wet Grinding

A colorant is added to/mixed with a melted resin, and the mixture is transferred into a solvent to be ground through an apparatus such as a ball mill under a proper temperature condition under presence of a protective colloid at need, thereby preparing toner particles.

Latex Mixing

A colorant is added to latex particles prepared by dispersion polymerization in a nonaqueous medium, and mixed through an apparatus such as a ball mill for preparing toner particles.

Interfacial Polymerization

A colorant such as a pigment and/or a dye is encapsulated by interfacial polymerization in a nonaqueous medium, thereby preparing resin particles for serving as toner particles. Resin for forming walls of microcapsules by the interfacial polymerization is insoluble in the nonaqueous dispersion medium. Such resin may be prepared from polyurethane resin or polyurea resin. Therefore, the resin can be prepared by interfacial polymerization by reacting a compound having at least two groups of amino group and/or hydroxyl group with a compound having at least two groups of isocyanate group. More specifically, the colorant to be encapsulated is dispersed or dissolved in a first compound which is insoluble in a nonaqueous dispersion medium, and thereafter the nonaqueous dispersion medium is added to the dispersed or dissolved solution under presence of a protective colloid at need for dispersing/emulsifying the solution, so that a second compound to be interfacially polymerized with the first compound is added to the dispersed/emulsified solution for interfacial polymerization.

Method of Introducing Polar Group into Toner Particles

According to the present invention, the polar group can be introduced into the toner particles by any of the following methods, for example:

(1) Resin containing an acid group or a basic group is employed as the main component of the toner particles. For example, resin such as an ethylene/methacrylic acid copolymer or a vinyl acetate/methacrylic acid copolymer which is copolymerized with a monomer having an acid group or a basic group is employed. If this resin is thermoplastic, the toner particles can be prepared by the aforementioned wet grinding. Namely, the thermoplastic resin having a polar group is sufficiently mixed with a colorant such as a pigment in a melted state, and thereafter the mixture is transferred into a medium for the liquid developer to be ground through an apparatus such as a ball mill under a proper temperature condition with addition of a protective colloid at need, thereby obtaining toner particles.

(2) In case of preparing the toner particles by mixing latex particles with a colorant, a first monomer having an acid group or a basic group and a second monomer are employed as the monomers of the latex and copolymerized with each other, thereby introducing the acid group or the basic group into the latex particles. The first monomer having an acid group or a basic group can be prepared from that described later.

(3) Each of the aforementioned methods (1) and (2) is adapted to introduce the polar group into the main component of the toner particles, i.e., not only into the surface layers but into the interiors of the toner particles. On the other hand, a method of introducing an acid group or a basic group into a protective colloid which is adsorbed in the surfaces of the toner particles can be employed as a method of selectively introducing the polar group into the surface layers of the toner particles. Such a protective colloid having a polar group can be prepared by copolymerizing the first monomer having a polar group described later with a second monomer.

The protective colloid is preferably amphipathic. Such an amphipathic protective colloid can be obtained by copolymerizing hydrophobic monomer and hydrophilic monomer with each other, and a protective colloid having a polar group can be prepared by further copolymerizing a monomer having the polar group with such hydrophobic and hydrophilic monomers.

The hydrophobic monomer can be prepared from a monomer such as cetyl methacrylate or lauryl methacrylate having relatively long-chain alkyl group. On the other hand, the hydrophilic monomer can be prepared from hydroxyethyl methacrylate or a polyethylene glycol adduct ("RMA-50M" (trade name) by Nippon Nyukazai Co., Ltd., for example) of hydroxyethyl methacrylate, for example.

Such provision of the polar group by the protective colloid is also applicable to the toner particles provided with the polar group by the aforementioned methods (1) and (2).

(4) If hydroxyl group is present on the surface layers of the toner particles, acid anhydride such as maleic anhydride or succinic anhydride can be reacted with the hydroxyl group for introducing an acid group into the surfaces. Such hydroxyl group on the surface layers of the toner particles may be present in the resin which serves as the main component of the toner particles, or in the protective colloid adsorbed on the surfaces of the toner particles.

Monomer Having A polar group

The monomer having an acid group can be prepared from (meth)acrylic acid, "Antox-MS-2N" (trade name) by Nippon Nyukazai Co., Ltd. having the structure of the following chemical formula 1, or "Antox-MS-$NH_4$" (trade name) by Nippon Nyukazai Co., Ltd. having the structure of the following chemical formula 2:

[Chemical Formula 1]

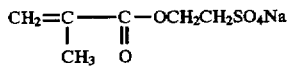

[Chemical Formula 2]

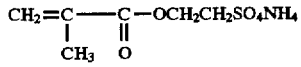

The monomer having a basic group can be prepared from dimethylaminoethyl (meth)acrylamide, diethylaminoethyl (meth)acrylate, dimethylaminopropyl (meth)acrylamide, or a compound prepared by quaternarizing the same.

The second monomer copolymerized with the monomer having a polar group can be prepared from that known as monomers for radical polymerization, such as the following (meth)acrylates, polymerizable aromatic compounds and monomers containing hydroxyl group:

(meth)acrylate: methyl acrylate, methyl methacrylate, ethyl acrylate, ethyl methacrylate, n-butyl acrylate, n-butyl methacrylate, isobutyl acrylate, 2-ethylhexyl acrylate, lauryl methacrylate, phenyl acrylate or the like polymerizable aromatic compound: styrene, α-methylstyrene, vinyl ketone, t-butylstyrene, parachlorostyrene, vinyl naphthalene or the like monomer containing hydroxyl group: 2-hydroxyethyl acrylate, 2-hydroxyethyl methacrylate, hydroxypropyl acrylate, hydroxypropyl methacrylate, hydroxybutyl acrylate, hydroxybutyl methacrylate, allyl alcohol, methallyl alcohol or the like The monomer having a polar group may be prepared from the following monomer known as a reactive emulsifier:

[Chemical Formula 3]

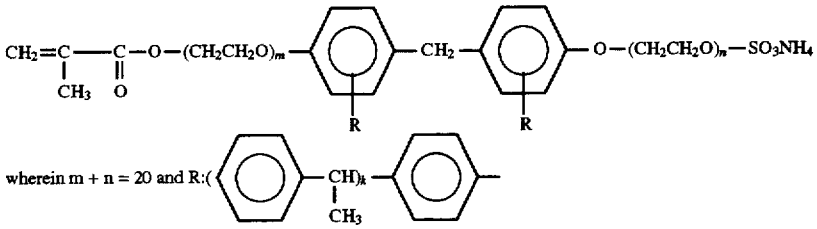

Antox-MS-60 (trade name) by Nippon Nyukazai Co., Ltd.

[Chemical Formula 4]

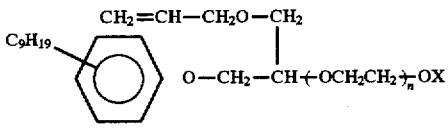

wherein X:H or $SO_3NH_4$

ADEKASOAP SE-10N (trade name) by Asahi Denka Kogyo K.K.

[Chemical Formula 5]

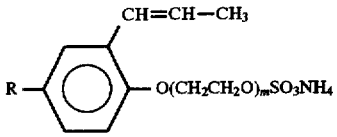

wherein R:$C_9H_{19}$ and m=10

AQUARON HS-10 (trade name) by Dai-ichi Kogyo Seiyaku Co., Ltd.

[Chemical Formula 6]

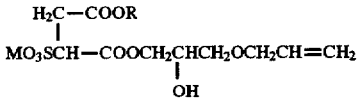

wherein R:$C_{18}H_{36}F_1$ and M:$NH_4$

LATEMUL S-180A (trade name) by Kao Corporation "Acrylester PA" (trade name) by Mitsubishi Rayon Co., Ltd.) or the like can be employed.

The aforementioned reactive emulsifier can be copolymerized with an acrylic monomer (MA-50, MA-100 or MA-150 (trade name) by Nippon Nyukazai Co., Ltd.) having a polyethylene oxide part, for example, for preparing a protective colloid serving as a dispersion stabilizer. As to the ratio of the copolymerization, 5 to 25 percent by weight of the aforementioned reactive emulsifier is preferably copolymerized with at least 40 percent by weight of the acrylic monomer having a polyethylene oxide part, with the rest of the aforementioned (meth)acrylate, polymerizable aromatic compound or monomer containing hydroxyl group.

Polymer

According to the present invention, the aforementioned polymer having a polar group of reverse polarity to those on the surface layers of the toner particles is added into the medium. Such a polymer can be prepared from a copolymer obtained by copolymerizing the aforementioned monomer having a polar group with a second monomer. The second monomer is not particularly restricted so far as the same is employable for vinyl polymerization, and can be prepared from the aforementioned (meth)acrylates, polymerizable aromatic compounds and monomers containing hydroxyl group, for example.

According to the present invention, the molecular weight of the polymer is not particularly restricted so far as the polymer can be dissolved even slightly in the medium for the liquid developer, while the molecular weight is preferably in the range of 2,000 to 200,000, more preferably in the range of 10,000 to 100,000, for example. If the molecular weight is too low, adsorbability to the toner particles may be so insufficient that chargeability of the toner particles tends to be reduced. If the molecular weight is too high, on the other hand, the toner particles are so readily aggregated that the electrophoretic speed tends to be reduced.

[Chemical Formula 7]

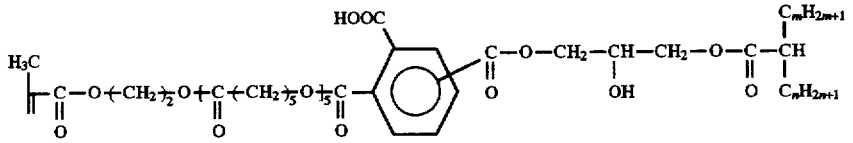

wherein m+n=9

The reactive emulsifier of the above chemical formula 7 is a compound having hydroxyl group on its ends obtained by adding 5 moles of ε-caprolactone on the average to 2-hydroxyethyl methacrylate, and is prepared by reacting and ring-opening trimellitic anhydride and reacting one of carboxylic group with long-chain epoxy (KARJULAR E).

In addition, a compound prepared by ring-opening phthalic anhydride with 2-hydroxyethyl methacrylate (e.g., The quantity of the polar group in the polymer is described above.

In the liquid developer according to the present invention, the time for adding the polymer is not restricted, so far as the polymer is contained in the medium in the finally obtained liquid developer. In general, however, the polymer is preferably added into the medium in which the toner particles are dispersed. The polymer is preferably added under stirring.

The polymer employed in the present invention is not restricted to a vinyl polymer but a polymer prepared by another polymerization method or a compound of a high molecular weight having a polar group can be employed.

Medium

While the medium employed for the inventive liquid developer is not particularly restricted so far as the same can be employed as a dispersion medium for the liquid developer, that having a volume specific resistance value of at least $10^9$ Ωcm is employed in general. The medium generally has a dielectric constant of at least 3.5. Such a nonaqueous dispersion medium can be prepared from aliphatic hydrocarbon, alicyclic hydrocarbon, aromatic hydrocarbon, halogenated hydrocarbon or polysiloxane. In consideration of volatility, safety, toxicity, odor and the like, an isoparaffin petroleum solvent is preferred. Such an isoparaffin petroleum solvent can be prepared from ISOPAR M, ISOPAR G, ISOPAR H, ISOPAR L or ISOPAR K (trade name) by Esso Sekiyu K.K., or SHELLSOL 71 (trade name) by Shell Sekiyu K. K..

Colorant

The colorant employed in the present invention is not particularly restricted but a colorant which is employable for a liquid developer can be widely used in general. For example, inorganic and organic pigments, dyes and mixtures thereof are known as examples of such a colorant.

Specific examples of the pigment are as follows:

magenta pigments: azolake, monoazo and quinacridone pigments etc. . . . C.I. Pigments Nos. Red-57-1, Red-31, Red-122, Red-48:3, Red-48:4 etc.

cyan pigments: phthalocyanine pigment etc. . . . C.I. Pigments Nos. Blue-60, Blue-15-6, Blue-15, Blue-15-2, Blue-15-3, Blue-15-4 etc.

yellow pigments: disazo and benzoimidazoline pigments etc. . . . C.I. Pigments Nos. Yellow-12, Yellow-13, Yellow-14, Yellow-17, Yellow-55, Yellow-83, Yellow-154 etc.

black pigments: carbon black, copper oxide, manganese dioxide, aniline black, activated carbon, magnetite, magnetic ferrite, non-magnetic ferrite etc.

Specific examples of the dye are as follows:

C.I. Direct Black 19, 22 and 154

C.I. Direct Yellow 12, 16 and 88

C.I. Direct Red 9, 13 and 17

C.I. Direct Blue 78 and 90

C.I. Acid Black 8, 31 and 52

C.I. Acid Yellow 23 and 25

C.I. Acid Red 37, 52, 92 and 94

C.I. Acid Blue 9 and 22

C.I. Food Black 2

While the content of the colorant is not particularly restricted, the weight of the colorant is preferably 5 to 40 percent by weight with respect to the total weight of the resin components of the toner particles and the colorant. No sharp image may be obtained if the content of the colorant is too small, while charge stability of the liquid developer may be deteriorated if the content of the colorant is too large.

While the inventive liquid developer can supply the toner particles with sufficient charge without adding a charge director dissimilarly to the prior art, such a charge director may be added into the inventive liquid developer. Therefore, any of the following charge directors, for example, may be added at need.

charge directors supplying positive charge:

dioctyl sodium sulfosuccinate, zirconium octoate, copper oleate, metal salt of naphthenic acid, complex metal salt of ethylenediaminetetraacetic acid, quaternary ammonium compound etc.

charge directors supplying negative charge:

lecithin, barium petronate, alkylsuccineimide, oil black BY etc.

As hereinabove described, the polar group on the surface layers of the toner particles may be provided by the protective colloid adsorbed on the surfaces of the toner particles. In this case, the composition of the medium containing the toner particles in a dispersed state may be changed from a first solvent composition having excellent dissolubility to the protective colloid to a second solvent composition having low dissolubility to the protective colloid, so that the protective colloid dissolved in the medium is deposited and adsorbed on the surfaces of the toner particles.

Such a protective colloid may be added in a step of preparing the toner particles in case of preparing the toner particles by interfacial polymerization. For example, a method including such an embodiment is adapted to prepare toner particles by encapsulating a colorant by reacting and interfacially polymerizing first and second resin precursors with each other in a nonaqueous medium, and comprises the steps of dispersing or dissolving the colorant in the first resin precursor, adding the dispersed or dissolved solution and a protective colloid to a first solvent composition having excellent dissolubility to the protective colloid and emulsifying the dispersed or dissolved solution of the first resin precursor, converting the first solvent composition to a second solvent composition having low dissolubility to the protective colloid, and adding the second resin precursor to the emulsified solution of the second solvent composition for interfacial polymerization, thereby encapsulating the colorant with a resulting resin to prepare the toner particles.

When the colorant is dispersed in the first resin precursor, a dispersion stabilizer may be employed at need.

As hereinabove described, the protective colloid is added to and dispersed in the first solvent composition having excellent dissolubility to the protective colloid and thereafter the first solvent composition is converted to the second solvent composition for rendering the protective colloid insoluble with respect to the medium, whereby the protective colloid can be more strongly and reliably adsorbed on the surfaces of the toner particles.

According to the present invention, the polymer, which contains a polar group of reverse polarity to the polar group of the surface layers of the toner particles and is soluble in the medium, is added into the medium. According to the present invention, it is presumed that the polar group on the surface layers of the toner particles further readily dissociate on the surfaces thereof when an electric field is applied to the liquid developer due to acid/base interaction between the polymer which is added into the medium in the aforementioned manner and the surface layers of the toner particles, whereby the charge quantity of the toner particles can be sufficiently increased.

According to the present invention, further, the polymer which is added into the medium is present in the vicinity of the toner particle surfaces, whereby the volume specific resistance of the medium is not remarkably reduced. Therefore, the inventive liquid developer can sufficiently increase the charge quantity of the toner particles without remarkably reducing the volume specific resistance.

According to the inventive liquid developer, therefore, a sufficient charge quantity can be maintained in a state having a high volume specific resistance, whereby high image density can be obtained to attain excellent repeatability for halftone dots or thin lines.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
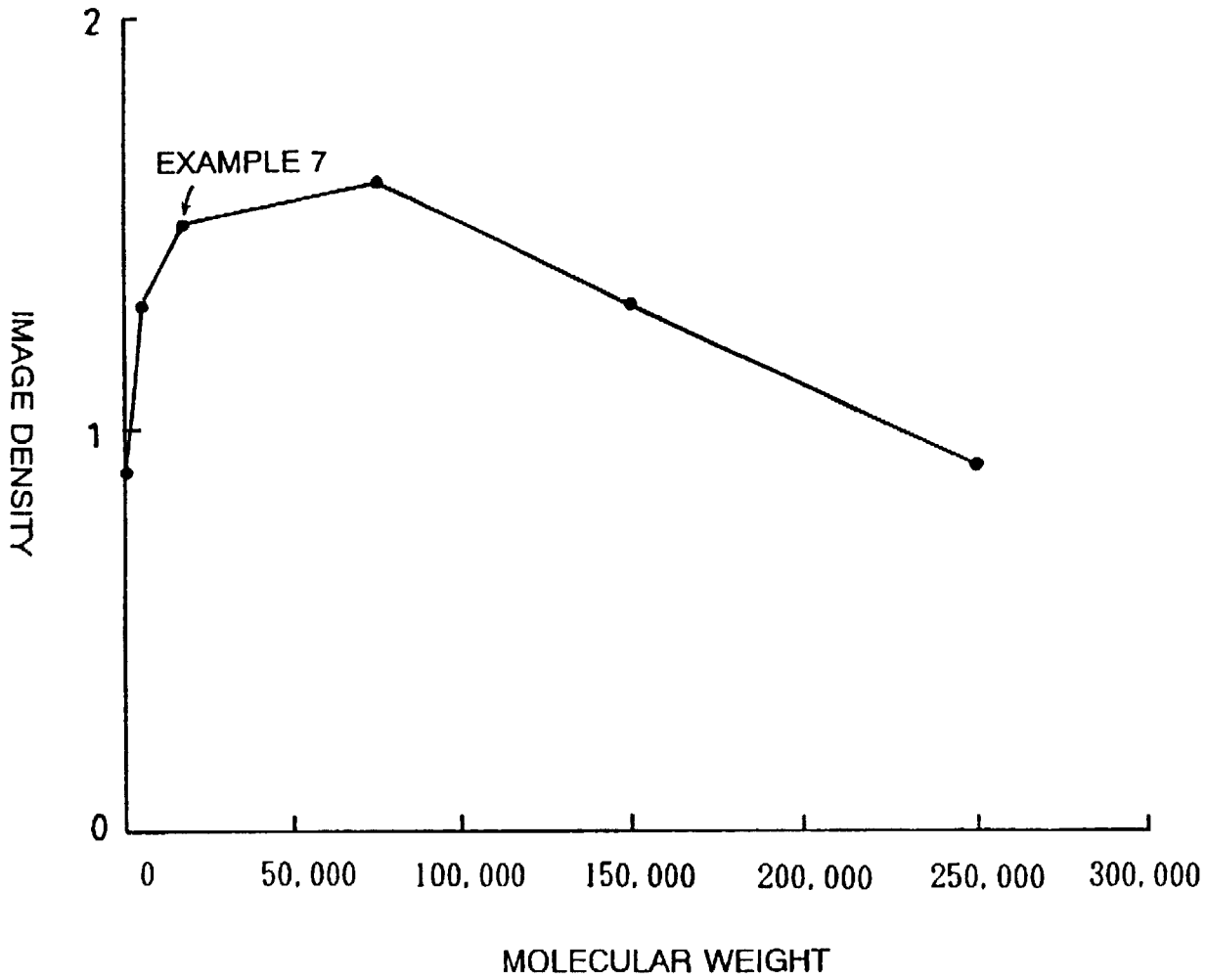
FIG. 1 illustrates the relations between number-average molecular weights of polymers and image density values in the present invention.

Synthetic Example 1 (Synthesis of Protective Colloid Containing Acid Group)

230 g of methyl ethyl ketone was introduced into a reaction vessel comprising a stirring heater, a thermometer, a nitrogen introduction tube and a cooling tube, and stirred in a nitrogen jet to be heated up to a temperature of 80° C. Further, a mixed solution of 65 g of cetyl methacrylate (CMA (trade name) by Nippon Oil and Fats Co., Ltd.), 15 g of polyethylene glycol (15) monomethacrylate (RMA-150M (trade name) by Nippon Nyukazai Co., Ltd.), 10 g of methyl methacrylate, 10 g of methacrylic acid and 1 g of 2,2'-azobis (cyanovaleric acid) (ACVA) was dripped for 2 hours, and thereafter reaction was continued for 5 hours. After the reaction, a de-solvent operation was performed with an evaporator. The obtained resin contained 90% of a nonvolatile component, and the number-average molecular weight measured with GPC was 12,000.

Synthetic Example 2 (Synthesis of Protective Colloid Containing Basic Group)

230 g of methyl ethyl ketone was introduced into a reaction vessel comprising a stirring heater, a thermometer, a nitrogen introduction tube and a cooling tube, and stirred in a nitrogen jet to be heated up to a temperature of 80° C. Further, a mixed solution of 65 g of cetyl methacrylate (CMA (trade name) by Nippon Oil and Fats Co., Ltd.), 15 g of polyethylene glycol (15) monomethacrylate (RMA-150M (trade name) by Nippon Nyukazai Co., Ltd.), 10 g of methyl methacrylate, 10 g of dimethylaminoethyl methacrylamide and 1 g of 2,2'-azobis(cyanovaleric acid) (ACVA) was dripped for 2 hours, and thereafter reaction was continued for 5 hours. After the reaction, a de-solvent operation was performed with an evaporator. The obtained resin contained 90% of a nonvolatile component, and the number-average molecular weight measured with GPC was 11,200.

Synthetic Example 3 (Synthesis of Polymer Containing Acid Group Soluble in Medium)

300 g of n-butyl alcohol was introduced into a reaction vessel comprising a stirring heater, a thermometer, a nitrogen introduction tube and a cooling tube, and stirred in a nitrogen jet to be heated up to a temperature of 80° C. Further, a mixed solution of 225 g of cetyl methacrylate (CMA (trade name) by Nippon Oil and Fats Co., Ltd.), 30 g of methyl methacrylate, 45 g of methacrylic acid and 3.0 g of 2,2'-azobisisobutyronitrile was dripped for 2 hours, and thereafter reaction was continued for 5 hours. After the reaction, a de-solvent operation was performed with an evaporator. The obtained resin contained 90 percent by weight of a nonvolatile component, and the number-average molecular weight measured with GPC was 19,200. A part thereof was diluted with ISOPAR M, to obtain a 5 wt. % solution.

Synthetic Example 4 (Synthesis of Polymer Containing Basic Group Soluble in Medium)

300 g of n-butyl alcohol was introduced into a reaction vessel comprising a stirring heater, a thermometer, a nitrogen introduction tube and a cooling tube, and stirred in a nitrogen jet to be heated up to a temperature of 80° C. Further, a mixed solution of 210 g of cetyl methacrylate (CMA (trade name) by Nippon Oil and Fats Co., Ltd.), 90 g of dimethylaminoethyl methacrylamide and 3.0 g of 2,2'-azobisisobutyronitrile was dripped for 2 hours, and thereafter reaction was continued for 5 hours. After the reaction, a de-solvent operation was performed with an evaporator. The obtained resin contained 90% of a nonvolatile component, and the number-average molecular weight measured with GPC was 17,600. A part thereof was diluted with ISOPAR M to obtain a 5 wt. % solution.

Synthetic Example 5 (Synthesis of Pigment Dispersant)

300 g of diethylene glycol was introduced into a reaction vessel comprising a stirring heater, a thermometer, a nitrogen introduction tube and a cooling tube, and stirred in a nitrogen jet to be heated up to a temperature of 75° C. Further, a mixed solution of 60 g of Antox-MS-$NH_4$ (trade name) by Nippon Oil and Fats Co., Ltd., 280 of polyethylene glycol (15) monomethacrylate (RMA-150M (trade name) by Nippon Nyukazai Co., Ltd., 40 g of hydroxyethyl methacrylate, 20 g of styrene, 100 g of diethylene glycol and 4.5 g of dimethyl 2,2'-azobis(2-methyl propionate) (V-601 (trade name) by Wako Pure Chemical Industries, Ltd.) was dripped for 2 hours, and thereafter reaction was continued for 7 hours. The number-average molecular weight measured with GPC was 14,200.

Synthetic Example 6 (Synthesis of Latex Particles Containing Acid Group)

322 g of ISOPAR M and 8 g (solid part) of the polymer of Synthetic Example 1 were introduced into a reaction vessel comprising a stirring heater, a thermometer, a nitrogen introduction tube and a cooling tube, and stirred in a nitrogen jet to be heated up to a temperature of 60° C. Further, a mixed solution of 30 g of ethyl acrylate, 60 g of methyl methacrylate, 10 g of methacrylic acid, 100 g of ISOPAR M and 2.0 g of lauroyl peroxide was added and thereafter reaction was continued for 24 hours. After the reaction, the grain size was measured with a particle size measurer (SALAD 2000A (trade name) by Shimadzu Corporation), to obtain a result of 0.55 μm.

Toner Example 1

Preparation of a negative charged toner by wet grinding is now described.

85 parts by weight of an ethylene/methacrylic acid copolymer (Nucrel 599 (trade name) by E. I. du Pont de Nemours and Co.) and 15 parts by weight of phthalocyanine blue (Blue #4911 (trade name) by Dainichiseika Colour & Chemicals Mfg. Co., Ltd.) were melted and kneaded until the pigment was finely dispersed, and thereafter mixed with a mixed solution of 400 parts by weight of ISOPAR M and 4.0 parts by weight of the protective colloid containing an acid group prepared in Synthetic Example 1. This mixture was introduced into a jacket type sand grinder, maintained at a temperature of 100° C., and stirred at 150 rpm for 30 minutes with iron balls of about 1.5 mm in diameter having apparently the same volume. Further, the temperature was reduced at a rate of 1° C./min. while continuing the stirring, which in turn was stopped when the temperature reached 30° C., and the iron balls were filtered off for obtaining a toner.

Toner Example 2

A toner was prepared in a similar manner to Toner Example 1, except that the pigment was replaced with dimethylquinacridone (Red #27 (trade name) by Dainichiseika Colour & Chemicals Mfg. Co., Ltd.).

Toner Example 3

A toner was prepared in a similar manner to Toner Example 1, except that the pigment was replaced with a disazo pigment (Yellow #22 (trade name) by Dainichiseika Colour & Chemicals Mfg. Co., Ltd.).

Toner Example 4

Preparation of a negative charged toner by latex mixing is now described.

340 parts by weight (with 85 parts by weight of a solid part) of the latex containing an acid group obtained in Synthetic Example 6 and 15 parts by weight of phthalocyanine blue (Blue #4911 (trade name) by Dainichiseika Colour & Chemicals Mfg. Co., Ltd.) were introduced into a jacket type sand grinder, maintained at a temperature of 20° C., and stirred at 1500 rpm for 60 minutes with iron balls of about 1.5 mm in diameter having apparently the same volume, and thereafter the iron balls were filtered off for obtaining a toner.

Toner Example 5

A toner was prepared in a similar manner to Toner Example 4, except that the pigment was replaced with dimethylquinacridone (Red #27 (trade name) by Dainichiseika Colour & Chemicals Mfg. Co., Ltd.).

Toner Example 6

A toner was prepared in a similar manner to Toner Example 4, except that the pigment was replaced with a disazo pigment (Yellow #22 (trade name) by Dainichiseika Colour & Chemicals Mfg. Co., Ltd.).

Toner Example 7

Preparation of a negative charged toner by interfacial polymerization is now described.

20 parts by weight (with 10 parts by weight of a solid part) of the pigment dispersant prepared in Synthetic Example 5, 10 parts by weight of phthalocyanine blue (Blue #4911 (trade name) by Dainichiseika Colour & Chemicals Mfg. Co., Ltd.), 20 parts by weight of diethylene glycol and 30 parts by weight of distilled water were introduced into a jacket type sand grinder, maintained at a temperature of 20° C., and stirred at 2000 rpm for 90 minutes with glass beads of about 1.5 mm in diameter having apparently the same volume, and thereafter the glass beads were filtered off for obtaining pigment-dispersed paste. Then, 80 parts by weight of this pigment-dispersed paste was emulsified with 120/18 parts by weight of ISOPAR M/isobutanol and 5.0 parts by weight of the protective colloid containing an acid group obtained in Synthetic Example 1. In this state, the protective colloid was soluble in a medium. Then, the mixture was diluted with 100 parts by weight of ISOPAR M, and the distilled water and isobutanol were removed under reduced pressure. In this state, the protective colloid was insoluble in the medium. Then, the emulsified solution was transferred into a reactor, and a mixed solution of 26 parts by weight of tolylenediisocyanate and 104 parts by weight of ISOPAR M was dripped for interfacially polymerizing diethylene glycol and tolylenediisocyanate with each other. The reaction was regarded as ended with disappearance of —N=C=O (2250 $cm^{-1}$)in an infrared absorption spectrum.

Toner Example 8

A toner was prepared in a similar manner to Toner Example 7, except that the pigment was replaced with dimethylquinacridone (Red #27 (trade name) by Dainichiseika Colour & Chemicals Mfg. Co., Ltd.).

Toner Example 9

A toner was prepared in a similar manner to Toner Example 7, except that the pigment was replaced with a disazo pigment (Yellow #22 (trade name) by Dainichiseika Colour & Chemicals Mfg. Co., Ltd.).

Toner Example 10

Preparation of a positive charged toner by interfacial polymerization is now described.

20 parts by weight (with 10 parts by weight of a solid part) of the pigment dispersant prepared in Synthetic Example 5, 10 parts by weight of phthalocyanine blue (Blue #4911 (trade name) by Dainichiseika Colour & Chemicals Mfg. Co., Ltd.), 20 parts by weight of diethylene glycol and 30 parts by weight of distilled water were introduced into a jacket type sand grinder, maintained at a temperature of 20° C., and stirred at 2000 rpm for 90 minutes with glass beads of about 1.5 mm in diameter having apparently the same volume, and thereafter the glass beads were filtered off for obtaining pigment-dispersed paste. Then, 80 parts by weight of this pigment-dispersed paste was emulsified with 120/18 parts by weight of ISOPAR M/isobutanol and 5.0 parts by weight of the protective colloid containing an acid group obtained in Synthetic Example 2. In this state, the protective colloid was soluble in a medium. Then, the mixture was diluted with 100 parts by weight of ISOPAR M, and the distilled water and isobutanol were removed under reduced pressure. In this state, the protective colloid was insoluble in the medium. Then, the emulsified solution was transferred into a reactor, and a mixed solution of 26 parts by weight of tolylenediisocyanate and 104 parts by weight of ISOPAR M was dripped for interfacially polymerizing diethylene glycol and tolylenediisocyanate with each other. The reaction was regarded as ended with disappearance of —N=C=O (2250 $cm^{-1}$ ) in an infrared absorption spectrum.

Toner Example 11

A toner was prepared in a similar manner to Toner Example 10, except that the pigment was replaced with dimethylquinacridone (Red #27 (trade name) by Dainichiseika Colour & Chemicals Mfg. Co., Ltd.).

Toner Example 12

A toner was prepared in a similar manner to Toner Example 10, except that the pigment was replaced with a disazo pigment (Yellow #22 (trade name) by Dainichiseika Colour & Chemicals Mfg. Co., Ltd.).

Example 1

100 parts by weight (with 20 parts by weight of a solid part) of the toner prepared in Toner Example 1 and 4 parts by weight (with 0.2 parts by weight of a solid part) of the polymer containing a basic group prepared in Synthetic Example 4 were mixed with each other under stirring by a mixing stirrer (Nippon Nyukazai Co., Ltd.0 by Nippon Nyukazai Co., Ltd.1).

Examples 2 to 9

The toners obtained in Toner Examples 2 to 9 were mixed with the polymer containing a basic group prepared in Synthetic Example 4 similarly to Example 1 under stirring.

Example 10

100 parts by weight (with 20 parts by weight of a solid part) of the toner prepared in Toner Example 10 and 4 parts by weight (with 0.2 parts by weight of a solid part) of the polymer containing a basic group prepared in Synthetic Example 3 were mixed with each other under stirring by a mixing stirrer (Nippon Nyukazai Co., Ltd.0 by Nippon Nyukazai Co., Ltd.1).

Examples 11 and 12

The toners obtained in Toner Examples 11 and 12 were mixed with the polymer containing a basic group prepared in Synthetic Example 3 similarly to Example 10 under stirring.

The toners obtained in Examples 1 to 9 were negatively charged, while those obtained in Examples 10 to 12 were positively charged.

Comparative Example A Series

The toners obtained in Toner Examples 1 to 12 were employed as comparative examples A1 to A12.

Comparative Example B Series

Basic Barium Petronate (trade name) for serving as a charge director was added to the negative charged toners obtained in Toner Examples 1 to 9 by 5 percent by weight with respect to solid parts of the toners, thereby preparing comparative examples B1 to B9 respectively.

On the other hand, lecithin was added to the positive charged toners obtained in Toner Examples 10 to 12 by 5 percent by weight with respect to solid parts of the toners, thereby preparing comparative examples B10 to B12 respectively.

Particle Sizes of Toners

The particle sizes of the toners obtained in Examples 1 to 12 and comparative examples A1 to A12 were measured by a particle size measurer (SALAD 2000A (trade name) by Shimadzu Corporation) respectively. The particle sizes were measured as area-average particle sizes (μm). Table 1 shows the results.

Table 1

It is clearly understood from the results shown in Table 1 that the particle sizes of the toner particles remain substantially unchanged when the polymer having reverse a polar group into the medium according to the present invention.

Evaluation of Image Density and Thin Line Repeatability of Negative Charged Toners Images were printed with the toners prepared in Examples 1 to 9 and comparative examples A1 to A9 and B1 to B9 respectively through a printer (SAVIN 9040), for evaluating image density, fogging and thin line repeatability. The toner concentrations were adjusted to 1.5 percent by weight. The image density and the fogging were measured with a Macbeth densitometer. As to the thin line repeatability, those superior, equivalent and inferior to that of the toner attached to SAVIN 9040 were evaluated as levels A, B and C respectively. Table 2 shows the results of the evaluation.

Table 2

Evaluation of Image Density and Thin Line Repeatability of Positive Charged Toners Image density, fogging and thin line repeatability were evaluated as to the toners prepared in Examples 10 to 12 and comparative examples A10 to A12 and B10 to B12, similarly to the aforementioned negative charged toners. Table 3 shows the results.

Table 3

It is clearly understood from Tables 2 and 3 that each of liquid developers containing the toners of Examples of the present invention has high image density, small fogging and excellent thin line repeatability.

Volume specific resistivity values of liquid developers containing the toners of Example 7 and comparative examples A7 and B7 were measured, with media of ISOPAR M and in toner concentrations of 1.5 percent by weight. Table 4 shows the results of the measurement.

Table 4

As shown in Table 4, it is understood that the toner of Example 7 according to the present invention has higher volume specific resistivity as compared with comparative examples A7 and B7.

Example 13

Polymers containing a basic group having different number-average molecular weights were added to the toner prepared in Toner Example 7, for studying the relation between the molecular weight of each polymer and image density of a liquid developer.

The polymers were prepared as copolymers from cetyl methacrylate and dimethylaminopropyl methacrylamide in the ratio of about 70/30, similarly to Synthetic Example 4. The polymerization was carried out by a method similar to that in Synthetic Example 4, while polymerization temperatures and initiator quantities were mainly changed to vary number-average molecular weights. Thus, polymers having number-average molecular weights of 1,480, 5,200, 17,600, 75,400, 153,000 and 248,000 respectively were obtained.

The obtained polymers were added to the toner prepared in Toner Example 7, to be 1 percent by weight with respect to the solid part. Image density values of the liquid developers prepared by adding the polymers were measured similarly to the above. FIG. 1 shows the results.

It is clearly understood from FIG. 1 that the image density is increased in the range of the molecular weight of 2,000 to 200,000, preferably in the range of 10,000 to 100,000.

Example 14

Figure 2:
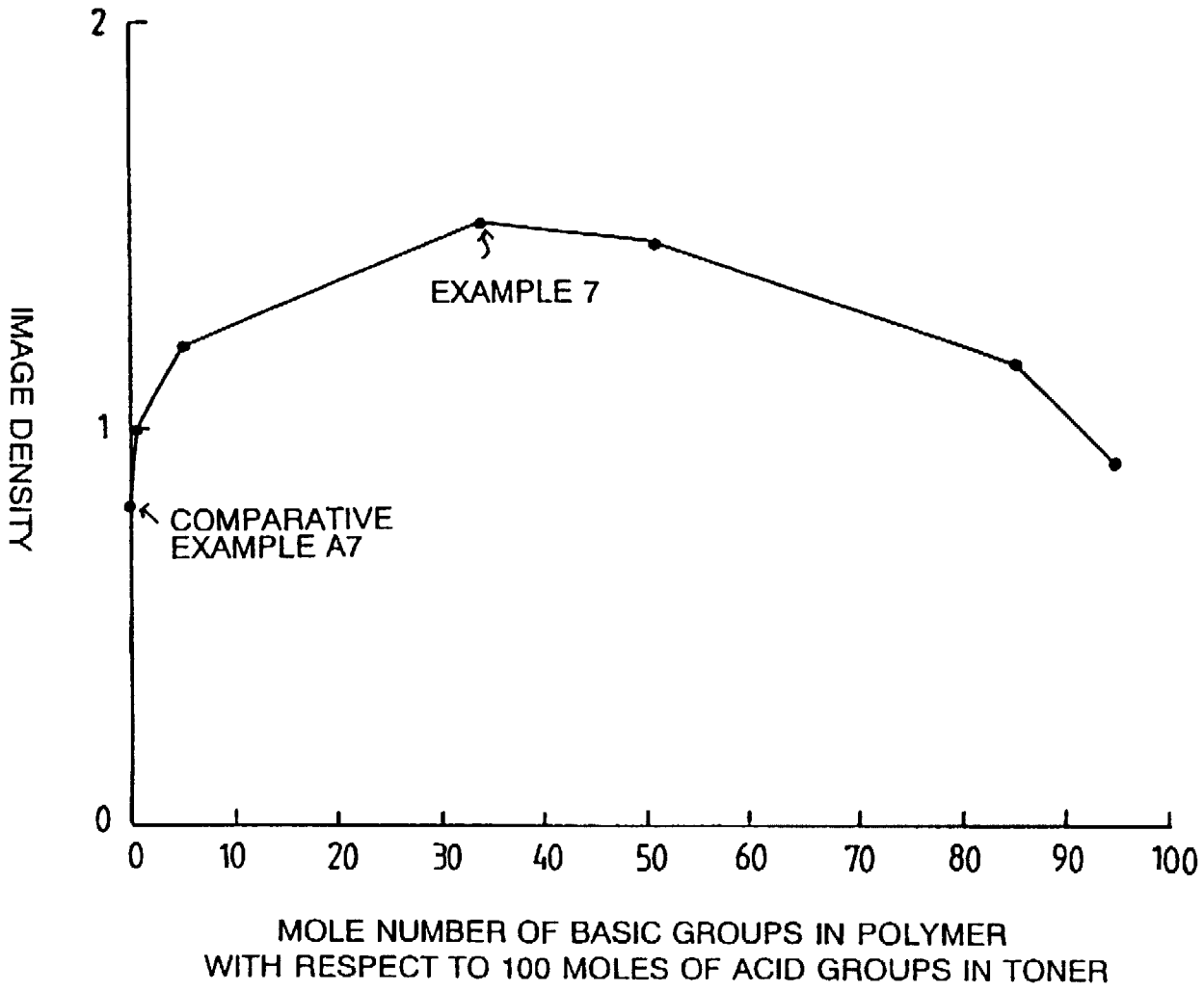
FIG. 2 illustrates the relations between contents of polymers and image density in Example of the present invention and comparative example.

In order to study influences varied with the contents of the polymer, the polymer containing a basic group prepared in Synthetic Example 4 was added to the toner prepared in Toner Example 7 in various ratios, and image density values of the obtained liquid developers were evaluated. The mole numbers of the basic group contained in the polymer were varied with respect to 100 moles of acid group in the toner as shown in FIG. 2, for measuring image density values similarly to the above. FIG. 2 shows the results.

As shown in FIG. 2, it is understood that the image density is increased in the range of 1 to 90 moles, preferably in the range of 10 to 80 moles, of the polymer.

Although the present invention has been described and illustrated in detail, it is clearly understood that the same is by way of illustration and example only and is not to be taken by way of limitation, the spirit and scope of the present invention being limited only by the terms of the appended claims.

TABLE 1

| No. | Comparative Example A | Example |
|---|---|---|
| 1 | 2.2 | 2.2 |
| 2 | 2.5 | 2.5 |
| 3 | 2.1 | 2.2 |
| 4 | 0.9 | 0.9 |
| 5 | 0.8 | 0.9 |

TABLE 1-continued

| No. | Comparative Example A | Example |
|---|---|---|
| 6 | 0.9 | 0.9 |
| 7 | 0.6 | 0.6 |
| 8 | 0.6 | 0.6 |
| 9 | 0.5 | 0.6 |
| 10 | 1.5 | 1.5 |
| 11 | 1.7 | 1.8 |
| 12 | 1.7 | 1.7 |

TABLE 2

| | Example | | | Comparative Example A | | | Comparative Example B | | |
|---|---|---|---|---|---|---|---|---|---|
| No. | Density | Fogging | Thin Line | Density | Fogging | Thin Line | Density | Fogging | Thin Line |
| 1 | 1.10 | 0.03 | A | 0.65 | 0.11 | B | 0.70 | 0.07 | C |
| 2 | 1.10 | 0.04 | A | 0.60 | 0.11 | B | 0.75 | 0.08 | C |
| 3 | 1.15 | 0.04 | A | 0.70 | 0.12 | B | 0.75 | 0.07 | C |
| 4 | 1.35 | 0.06 | B | 0.70 | 0.16 | C | 0.85 | 0.10 | C |
| 5 | 1.30 | 0.06 | B | 0.70 | 0.15 | C | 0.80 | 0.10 | C |
| 6 | 1.35 | 0.05 | B | 0.65 | 0.13 | C | 0.90 | 0.09 | C |
| 7 | 1.50 | 0.03 | A | 0.80 | 0.12 | B | 0.95 | 0.07 | C |
| 8 | 1.45 | 0.03 | A | 0.85 | 0.12 | B | 0.90 | 0.07 | C |
| 9 | 1.50 | 0.02 | A | 0.90 | 0.10 | B | 0.95 | 0.08 | C |

TABLE 3

| | Example | | | Comparative Example A | | | Comparative Example B | | |
|---|---|---|---|---|---|---|---|---|---|
| No. | Density | Fogging | Thin Line | Density | Fogging | Thin Line | Density | Fogging | Thin Line |
| 10 | 1.45 | 0.03 | A | 0.75 | 0.13 | B | 0.90 | 0.08 | C |
| 11 | 1.50 | 0.02 | A | 0.75 | 0.13 | B | 0.95 | 0.08 | C |
| 12 | 1.50 | 0.03 | A | 0.80 | 0.12 | B | 0.95 | 0.09 | C |

TABLE 4

| (Ω cm) | | |
|---|---|---|
| Example 7 | Comparative Example A7 | Comparative Example B7 |
| $2.0 \times 10^{12}$ | $1.5 \times 10^{11}$ | $2.5 \times 10^{11}$ |

What is claimed is:

1. A liquid developer comprising:

a medium:

toner particles having surfaces and being dispersed in said medium;

a protective colloid having a polar group of either an acid group or a basic group and being adsorbed on said surfaces of said toner particles so that said polar group is located on said surfaces of said toner particles; and a polymer having a polar group of reverse polarity to said polar group of said protective colloid and being dissolved in said medium.

2. The liquid developer in accordance with claim 1, wherein the quantity of said polar group on said toner particles is 0.005 to 5 mM per gram of solid parts of said toner particles.

3. The liquid developer in accordance with claim 1, wherein the quantity of said polar group contained in said polymer is 0.005 to 5 mM per gram of said polymer.

4. The liquid developer in accordance with claim 1, wherein the mole ratio of said polar group on said toner particles to said polar group contained in said polymer (polar group on toner particles/polar group in polymer) is 100/90 to 100/1.

5. The liquid developer in accordance with claim 1, wherein said toner particles are resin particles being prepared by encapsulating a colorant by interfacial polymerization in a nonaqueous medium.

6. The liquid developer in accordance with claim 1, wherein said toner particles are obtained by adding a colorant into latex particles in a nonaqueous medium.

7. The liquid developer in accordance with claim 1, wherein said toner particles are obtained by mixing a colorant with a melted resin, and then cooling and grinding the the mixture.

8. The liquid developer in accordance with claim 8, wherein said toner particles are prepared by changing the composition of said medium containing said toner particles in a dispersed state, from a first solvent composition having excellent dissolubility to said protective colloid to a second solvent composition having low dissolubility to said protective colloid, so that said protective colloid dissolved in said medium is adsorbed on said surfaces of said toner particles.

* * * * *